US006086818A

United States Patent [19]

Stomp et al.

[11] Patent Number: 6,086,818

[45] Date of Patent: Jul. 11, 2000

[54] DEVICE FOR COUPLING A BLOWING LANCE TO A COLLECTOR

[75] Inventors: Hubert Stomp, Howald; Serge Devillet, Buerden; Fred Parasch, Esch/Alzette, all of Luxembourg; Daniel Fries, Arlon, Belgium

[73] Assignee: Paul Wurth S.A., Luxembourg, Luxembourg

[21] Appl. No.: 09/255,840

[22] Filed: Feb. 23, 1999

Related U.S. Application Data

[63] Continuation of application No. PCT/EP97/03423, Jul. 1, 1997.

[30] Foreign Application Priority Data

Aug. 28, 1996 [LU] Luxembourg ..... 88808

[51] Int. Cl.[7] ..... C21C 5/32

[52] U.S. Cl. ..... 266/225; 266/226

[58] Field of Search ..... 266/226, 225

[56] References Cited

U.S. PATENT DOCUMENTS

| | | | |
|---|---|---|---|
| 3,972,515 | 8/1976 | Mercatoris | 266/225 |
| 4,083,540 | 4/1978 | Berry et al. | 266/225 |
| 5,037,069 | 8/1991 | Stomp et al. | 266/226 |
| 5,167,904 | 12/1992 | Stomp et al. | 266/226 |
| 5,301,928 | 4/1994 | Stomp et al. | 266/226 |

FOREIGN PATENT DOCUMENTS

| | | |
|---|---|---|
| 0552440A | 7/1993 | European Pat. Off. . |
| 2512487A | 10/1975 | Germany . |
| 87 425 | 12/1989 | Luxembourg . |
| WO9005790A | 5/1990 | WIPO . |

OTHER PUBLICATIONS

English language version of French International Preliminary Examination Report dated May 27, 1998.
WO 98/08983 (Cover Sheet Only) Dec. 1998.

*Primary Examiner*—Scott Kastler
*Attorney, Agent, or Firm*—Smith, Gambrell & Russell, LLP

[57] ABSTRACT

A device for coupling a blow lance with a header is disclosed, in which the force required for producing a sealing joint between the header (2) and the lance (4) is exerted by a cooling fluid and/or a blowing fluid. In a preferred embodiment, said cooling fluid and/or blowing fluid acts via a pressure surface (32) on the joint between the header (2) and the lance (4), the pressure surface being integral with a piston (22) which transmits the pressure to said joint. The lance has preferably a first coupling surface (12), while the header (2) has a second coupling surface (14), and one of said coupling surfaces (12 or 14) is integral with said piston (22).

20 Claims, 1 Drawing Sheet

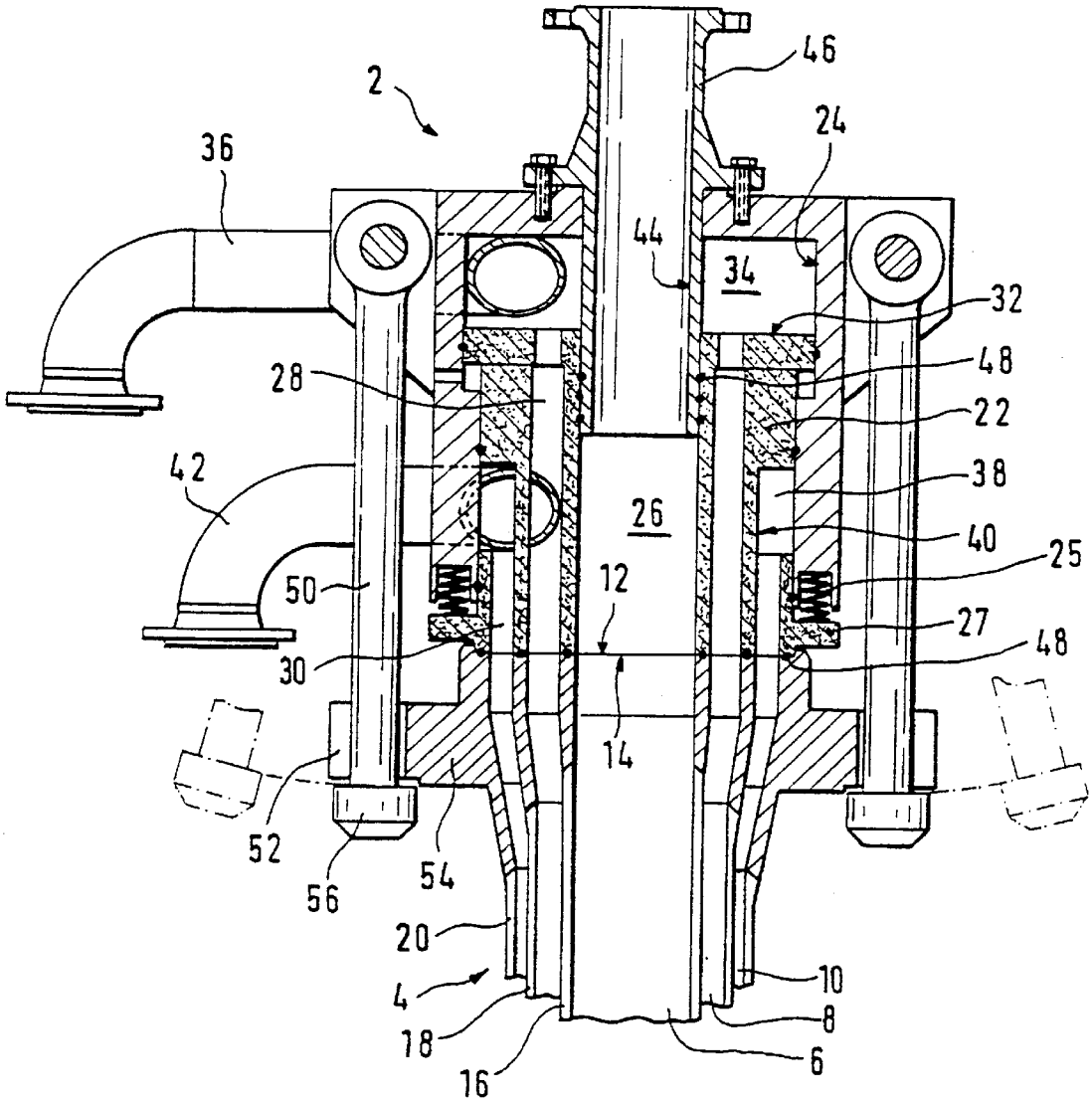
2
36
46
24
44
34
32
48
28
22
42
38
26
40
25
50
12
27
30
48
14
52
56
54
20
4
10
8
18
6
16

DEVICE FOR COUPLING A BLOWING LANCE TO A COLLECTOR

This application is a continuation of PCT/EP97/03423 having an international filing date of Jul. 1, 1997. PCT Patent Application No. PCT/EP97/03423 is incorporated herein by reference.

The present invention relates to a device for coupling a blowing lance to a collector.

Blowing lances are used, for example, for the conversion of pig iron to steel by blowing oxygen on to the metallic bath in a converter. In order to avoid premature damage to the lances due to the high temperatures in the converter, blowing lances are generally cooled using a cooling fluid, water for example, which circulates in a cooling circuit. For this purpose, a lance generally incorporates two annular chambers arranged coaxially around the oxygen channel in the lance and connected in the region of the nose-piece of the lance so as to form a supply channel and a return channel, both annular, for the cooling fluid. Consequently, during its operation, such a lance must be connected to at least three ducts carrying fluids for cooling and blowing.

Blowing lances must be changed because of wear after a given period of use. With a view to rapid and easy replacement of a damaged lance by a new lance, numerous devices have been proposed for partially automating the connecting of the lance to the ducts necessary for its operation, i.e. to allow the concomitant connection of all the necessary ducts. Such devices comprise a coupling head with a first coupling surface and a clamping device for pressing the first coupling surface on to a second coupling surface of the lance in an impervious manner. The coupling head incorporates several coaxial channels whose first end is connected to one of the ducts carrying the fluids for cooling and blowing and whose second end opens into the first coupling surface. Similarly, the coaxial channels of the lance open into the second coupling surface so that, after establishment of the impervious contact between the two elements by means of the clamping device, a transfer of the fluids is made possible at the junction between the head and the lance.

Thus, the document DE-A-25 12 487 proposes a coupling device in which the lance is suspended from the coupling head and fixed to the latter using two fastening bolts and associated nuts. The bolts are mounted at the level of the coupling head in such a way as to tilt laterally and are engaged in two notches in a flange forming part of the lance. The force necessary to form the impervious junction between the two coupling surfaces is then established by tightening the two nuts.

Although it is very simple and compact, this device nevertheless has a few disadvantages. In fact, changing the lance firstly requires manual work, such as the loosening and tightening of the bolts, which implies a risk of accident in view of the environment in which this work is carried out, and secondly it means that the static method of achieving imperviousness, i.e. the direct clamping together of the two coupling surfaces, poses a problem during abrupt variations in the pressure of the cooling and blowing fluids. Such variations, which occur for example as a transient effect in the form of hammering, are propagated through the cooling system and may cause a temporary breakdown in the imperviousness at the joint between the coupling head and the lance. One way of remedying such a breakdown would be to tighten the nuts even further in order to increase the force pressing the two coupling surfaces together. However, the clamping force between the two coupling surfaces may not be increased indefinitely in case the impervious nature of the coupling surfaces is destroyed.

The objective of the present invention is to propose a coupling device for a blowing lance, enabling the pressure between the collector and the lance to adapt dynamically as a function of the pressure variations in the cooling and/or blowing fluids.

In conformity with the invention, this objective is attained by a device for coupling a blowing lance to a collector, in which the force required for an impervious junction between the collector and the lance is exerted by the cooling fluid and/or the blowing fluid. In such a device, the pressure force between the lance and the collector is not exerted statically by a conventional clamping means but is exerted dynamically by one of the fluids necessary for the functioning of the lance. This means that the pressure force between the collector and the lance varies with the pressure of the fluid in question. Consequently, abrupt variations in the fluid pressures may be compensated dynamically so that even very violent hammering does not lead to any risk of a breakdown in the imperviousness of the system. Moreover, no adjustment of the clamping force of the clamping means is required when the device is used under extreme conditions, i.e. at high fluid pressures. In fact, the dynamic adaptation of the force pressing the two coupling surfaces together automatically increases the pressure force as soon as the pressure of the fluids increases and thus preserves a previously established basic imperviousness with a certain safety margin.

In a preferred embodiment, the said cooling fluid and/or blowing fluid acts through the intermediary of a pressure surface on the junction between the collector and the lance. It is known that the pressure force between the collector and the lance is proportional to the fluid pressure and to the area of the pressure surface. This is a clear reference to the effective area of the pressure surface. The value of the pressure force for a given fluid pressure can therefore be predetermined by choosing appropriate dimensions for the said pressure surface.

The pressure surface is, for example, an integral part of a piston which transmits the pressure force to the said junction. Preferably, the lance has a first coupling surface, the collector has a second coupling surface and one of the two said coupling surfaces is an integral part of the said piston and is opposite to the pressure surface. The piston may equally well form part of the lance or of the collector. It incorporates one of the two coupling surfaces necessary for the junction and clamps the said coupling surface in an impervious manner against the other of the two coupling surfaces.

In a preferred embodiment, the piston is embedded in a recess in the collector so that the said pressure surface defines a pressure chamber at the bottom of the said recess. In this way, the pressure chamber may be connected directly to the supply duct for the cooling and/or the blowing fluid. The integration of the piston into the collector also reduces the investment costs, given that a refining unit comprises several lances for each individual collector.

Advantageously, the piston is made in such a way that the said pressure force exerted by the said piston is greater than the reaction force acting on the plane of the junction between the said collector and the said lance. In this case, the difference between the imperviousness obtained by the pressure force and the required imperviousness, which forms the safety margin, progressively increases as the pressure of the cooling and/or blowing fluid increases.

A preferred embodiment of the invention consists of a device for coupling a blowing lance to a collector which is connected to ducts carrying blowing and cooling fluids, the lance comprising first channels for the said fluids which extend through the said lance and which open at one end into a first coupling surface, the collector comprising second channels for the said fluids, each of the said second channels being associated with one of the said first channels, being connected to one of the said ducts and opening at one end into a second coupling surface, the said second coupling surface being associated with the said first coupling surface and being capable of being pressed against the latter using a clamping means so as to form an impervious junction between the said first and second associated channels. The said collector comprises a coupling head, and the said second coupling surface is an integral part of a piston which is embedded in an axial recess of the said coupling block so that a pressure surface defines a pressure chamber at the bottom of the said recess, the said pressure surface of the piston being opposite the second coupling surface. A supply duct is connected to the said pressure chamber in such a way that the fluid supplied through the said supply duct exerts a pressure on the said pressure surface and so that, consequently, the piston exerts a pressure force on the said first coupling surface.

In this device, only a part of the pressing force necessary to make the junction between the coupling head and the lance impervious is exerted by a conventional clamping means, i.e. statically. This produces a certain basic pressure force which guarantees the minimum required imperviousness. During the refining, the pressure of the fluid supplied by the duct connected to the pressure chamber, preferably the cooling fluid, exerts a pressure on the pressure surface of the piston, and as a result the piston exerts a pressure force on the first coupling surface of the lance. Because of the effective pressure surfaces for the fluids and the head loss in the cooling system between the supply duct and the return duct, this pressure force is greater than or equal to the reaction force exerted on the junction between the coupling head and the lance. The result of this is an increase in the force pressing together the two coupling surfaces and hence in the imperviousness of the coupling. As described above, this device makes it possible to compensate dynamically for abrupt variations in the fluid pressures and to adapt automatically to extreme conditions, i.e. to high fluid pressures, while maintaining a safety margin in the form of the minimum required imperviousness established by the clamping means.

In a preferred embodiment of the invention, the device comprises coupling means for suspending the lance from the said coupling head. The said coupling means comprise, for example, hooks which are mounted so that they pivot on the said coupling head and which may engage with trunnions extending radially from the said lance. In another embodiment, the said coupling means comprise locking rods which are mounted so that they pivot on the said coupling head together with a radial flange on the said lance on the side of the first coupling surface, the said radial flange having radial notches designed to receive the locking rods so that the heads of the said locking rods bear on the side of the said flange which is opposite the first coupling surface. These two embodiments of the coupling means remove the need for manual work such as the tightening and loosening of nuts. The coupling is carried out more quickly and constitutes less risk for staff. Fixing with the help of locking rods is particularly advantageous, because it enables the stroke of the piston to be reduced to a minimum. In fact, to replace a coupled lance, the lance must be moved through a certain distance in the direction of the coupling head until the heads of the locking rods can pass the lower edge of the said flange in order to be moved away sideways. As the piston presses on the lance, it must also be moved through the same distance, which must take place if necessary against the action of the clamping means. The distance to be moved should therefore be limited in order to limit the work that has to be done to move the piston, for example against the action of the clamping means or of its weight.

The clamping means preferably comprise springs which are positioned between the coupling head and the said piston, the said springs being pre-stressed during the coupling of the lance to the coupling head.

In order to facilitate the centring of the said two coupling surfaces, one of the said two coupling surfaces advantageously incorporates a protruding annular edge extending axially, the said annular edge having an inner diameter which is roughly equal to the outer diameter of the other of the said coupling surfaces.

BRIEF DESCRIPTION OF THE DRAWING

FIG. 1 shows a preferred embodiment of the invention.

To go a little further, a preferred embodiment of the invention is described with the help of FIG. 1, which shows a vertical cross-section through a coupling for blowing lances. It comprises a coupling head 2 which is connected to ducts for the cooling and blowing fluids (not represented) to which a blowing lance 4 is coupled. The lance 4 comprises a central channel 6 for a blowing gas, oxygen for example, which is surrounded coaxially by two chambers 8, 10 with annular cross-sections. The two chambers 8, 10 are connected in the region of the nose-piece (not represented) of the lance 4 so as to form a supply channel 8 and a return channel 10 with annular cross-sections for the cooling fluid. It should be noted that the lance could include additional channels for other blowing gases. These channels would then be located coaxially between the central channel and the cooling circuit channels.

On the coupled end of the lance 4, the channels 6, 8 and 10 open into a first coupling surface 12, which is associated with a second coupling surface 14 of the coupling head 2. In the said first coupling surface 12, the channels 6, 8 and 10 then form coaxial annular outlets which are separated radially by the annular front faces of the tubular walls 16, 18 and 20 of the different channels. The walls 16, 18 and 20 are reinforced in the region of the first coupling surface 12 and their front faces are made in the form of impervious surfaces.

In order to allow a transfer of the cooling and blowing fluids from the coupling head 2 to the lance 4, the first coupling surface 12 must be pressed imperviously against the second coupling surface 14 and a connection between the channels 6, 8 and 10 and the ducts carrying the respective cooling and blowing fluids must be established.

To achieve this, the coupling head 2 advantageously incorporates a piston 22 which is mounted axially so that it slides in a recess 24 of the coupling head 2 and which can establish an impervious contact with the first coupling surface 12 under the action of a clamping means 25. This piston 22 then has the second coupling surface 14 on an end oriented towards the lance 4 and comprises channels 26, 28 and 30 for the cooling and blowing fluids which are allocated to the channels 6, 8 and 10 of the lance 4. One end of each channel 26, 28 and 30 opens in such a way into the second coupling surface 14 that the outlets of the channels 6, 8 and 10 into the first coupling surface 12 and the outlets of the respective channels 26, 28 and 30 in the second coupling surface 14 are exactly superimposed on each other during the coupling. In this case, the outlets of the channels 26, 28 and 30 in the second coupling surface 14 are separated, in a way similar to the outlets of the channels 6, 8 and 10 in the first coupling surface 12, by the annular front faces of the tubular walls separating the different channels 26, 28 and 30. These annular front faces are then also made in the form of impervious surfaces and, during the coupling, press against the respective annular front faces in the first coupling surface 12.

The clamping means 25 which press the second coupling surface 14 of the piston 22 against the first coupling surface 12 of the lance preferably comprise springs that are placed in a groove in the front surface of the coupling head 2 and press against a radial protrusion 27 from the piston. These springs 25 are then pre-stressed during the coupling of the lance 4 and thus exert a force on the piston 22 in the direction of the lance 4. It is clear that any other clamping means would be suitable for pressing the piston 22 against the lance 4, for example hydraulic jacks, endless screws actuated by any type of motor, etc., or a combination of these.

On its end opposite the second coupling surface 14, the piston 22 has a pressure surface 32 by which it defines a pressure chamber 34 in the bottom of the recess 24. Through this pressure chamber 34, which in the example represented is connected to the cooling fluid supply duct through the intermediary of a connecting pipe 36, the lance 4 is supplied with cooling fluid. For this purpose, the cooling fluid supply channel 28 opens into the pressure surface 32 so that it is connected to the pressure chamber 34. The cooling fluid return channel 30 advantageously opens into an annular chamber 38, bounded by a circumferential groove 40 in the piston and the side wall of the recess 24. This annular chamber 38 is then connected to a pipe for connection to the cooling fluid return duct 42. It should be noted that the axial dimension of the circumferential groove 40 is greater than the axial dimension of the mouth of the discharge pipe 42 so that the mouth of the discharge pipe 42 is not obstructed by the lateral surface of the piston during its axial displacement.

The blowing fluid channel 26 opens into the pressure surface 32 of the piston 22 and is extended imperviously through the pressure chamber 34 through the intermediary of a tube 44, one end of which is embedded so that it slides imperviously in the said channel 26, and the other end of which extends through the bottom of the recess 24 to exit at the top of the coupling head 2, where it terminates in a pipe 46 for connection to the blowing fluid duct. It should be noted that the junction between the tube 44 and the channel 26 is rendered impervious by means of several O-rings 48 positioned around the embedded end of the tube 44. Similarly, the pressure chamber 34 and the annular chamber 38 are rendered impervious by means of O-rings which are, for example, positioned in circumferential grooves of the piston 22. An alternative mode of execution for the connection of the channel 26 to the respective supply duct is to extend the channel 26 beyond the pressure surface 32 so that it passes through the pressure chamber 34 and extends through a bore in the bottom of the recess 24 to exit at the top of the coupling head 2. In this case, the channel 26 is guided imperviously through the bore in the bottom of the recess by sliding axially. Outside the coupling head 2, the channel 26 can then be connected to the blowing gas supply duct through the intermediary of a flexible expansion joint, which makes it possible to produce a connection that is impervious and capable of adaptation to axial movements of the channel 26.

In order to couple a lance 4 to this coupling device, the lance is conveyed by a bridge or an ad hoc handling system which positions it with its coupling surface 12 below the coupling surface 14 of the coupling head 2 so that the axes of the lance 4 and the coupling head 2 are aligned. Under the action either of its weight or of the clamping means 25, the piston 22 and hence the second coupling surface 14 are located at this moment in their lowest position with respect to the coupling head 2. The lance 4 is then raised until the two coupling surfaces 12 and 14 come into contact. In order to facilitate the centring of the two coupling surfaces 12 and 14, one of the two surfaces (in FIG. 1, the first coupling surface 12), incorporates an annular edge 48 which extends axially and has an inner diameter roughly equal to the outer diameter of the other of the said coupling surfaces 14.

After establishing contact between the two coupling surfaces, the lance 4 is raised further and the piston 22 is moved against the action of the springs 25. It should be noted that the weight of the collector and its peripheral equipment acts here as a counter-force, so that the springs 25 may be pre-stressed by a force roughly equivalent to this weight. The lance 4 is then advantageously attached by two locking rods 50 mounted on either side of the coupling head 2 and received by two notches 52 in a radial flange 54 of the lance 4, so that the heads 56 of the locking rods 50 press against the lower surface of the flange 54. In order to be able to remove the lance 4, the locking rods 50 are mounted pivotally on the coupling head 2 so that their heads 56 may be moved away sideways (as indicated in the FIGURE).

In this way, a "basic" coupling is achieved under the action of the springs 25, a coupling which has the minimum imperviousness necessary for starting the supply of the cooling fluid. While the cooling fluid is being supplied, the pressure of the cooling fluid exerts a pressure on the pressure surface 32 of the piston 22 and the piston 22 therefore exerts a pressure force on the first coupling surface 12 of the lance 4. It will be obvious to one skilled in the art that the piston 22 should be so dimensioned that, because of the effective pressure surfaces for the fluids and the head loss in the cooling system between the supply duct and the return duct, the pressure force exerted by the piston should be greater than or equal to the reaction force exerted on the junction between the coupling head and the lance. In this case, the result is an increase in the force pressing the two coupling surfaces together and hence an increase in the imperviousness of the coupling. This device thus makes it possible to compensate dynamically for abrupt variations in the fluid pressures and to adapt automatically to extreme conditions.

Moreover, it should be pointed out that the piston might equally well be subjected to the pressure of the blowing gas as to the pressure of the cooling fluid.

What is claimed is:

1. Device for coupling a blowing lance to a collector, characterized in that the force necessary for an impervious junction between the collector (2) and the lance (4) is exerted by a cooling fluid and/or a blowing fluid which is supplied to said lance.

2. Coupling device according to claim 1, characterised in that the said cooling fluid and/or the blowing fluid acts through the intermediary of a pressure surface (32) on the junction between the collector (2) and the lance (4).

3. Coupling device according to claim 2, characterised in that the pressure surface (32) is an integral part of a piston (22) which transmits the pressure force to the said junction.

4. Coupling device according to claim 3, characterised in that the lance (4) has a first coupling surface (12), in that the collector (2) has a second coupling surface (14), and in that one of the two coupling surfaces (12 or 14) is an integral part of the said piston (22).

5. Coupling device according to claim 3, characterised in that the piston (22) is embedded in a recess (24) in the collector, so that the said pressure surface (32) defines a pressure chamber (34) at the bottom of the said recess (24).

6. Device according to claim 3, characterised in that the piston (22) is made in such a way that the said pressure force exerted by the said piston (22) is greater than the reaction force acting on the plane of the junction between the said collector (2) and the lance (4).

7. Device for coupling a blowing lance to a collector which is connected to ducts carrying blowing and cooling fluids, the lance (4) comprising first channels (6, 8, 10) for the said fluids which extend through the said lance (4) and which open at one end into a first coupling surface (12), the collector comprising second channels (26, 28, 30) for the said fluids, each of the said second channels (26, 28, 30) being associated with one of the said first channels (6, 8, 1 0), being connected to one of the said ducts and opening at one end into a second coupling surface (14), the said second coupling surface (14) being associated with the said first coupling surface (12) and being capable of being pressed against the latter using a clamping means (25) so as to form an impervious junction between the said first (6, 8, 10) and second (26, 28, 30) associated channels, characterised in that the said collector comprises a coupling head (2), in that the second coupling surface (14) is an integral part of a piston (22), which is embedded in an axial recess (24) in the said coupling head (2) so that a pressure surface (32) defines a pressure chamber (34) at the bottom of the said recess (24), the said pressure surface (24) of the piston (22) being opposite the second coupling surface (14), and in that a supply duct is connected with the said pressure chamber (34) in such a way that the fluid supplied through the said supply duct exerts a pressure on the said pressure surface (32) and so that the piston (22) exerts a pressure force on the said first coupling surface (12).

8. Device according to claim 7, characterised by coupling means to suspend the lance (4) from the said coupling head (2).

9. Device according to claim 8, characterised in that the coupling means comprise hooks which are mounted so that they pivot on the said coupling head and which may engage with trunnions extending radially from the said lance (4).

10. Device according to claim 8, characterised in that the coupling means comprise locking rods (50) which are mounted so that they pivot on the said coupling head (2) and a radial flange (54) on the said lance (4) on the side of the first coupling surface (12), the said radial flange (54) having radial notches (52) designed to receive the locking rods (50) so that the heads (56) of the said locking rods (50) bear on the side of the said flange (54) which is opposite the first coupling surface (12).

11. Device according to claim 7, characterised in that the said clamping means (25) comprise springs which are positioned between the coupling head (2) and the said piston (22), the said springs being pre-stressed during the coupling of the lance (4) to the coupling head (2).

12. Device according to claim 7, characterised in that one of the said two coupling surfaces (12 or 14) comprises a protruding annular edge (48) extending axially, the said annular edge (48) having an inner diameter which is roughly equal to the outer diameter of the other of the said coupling surfaces (14 or 12).

13. Coupling device according to claim 4, characterized in that the piston (22) is embedded in a recess (24) in the collector, so that the said pressure surface (32) defines a pressure chamber (34) at the bottom of the said recess (24).

14. Device according to claim 4, characterized in that the piston (22) is made in such a way that the said pressure force exerted by the said piston (22) is greater than the reaction force acting on the plane of the junction between the said collector (2) and the lance (4).

15. Device according to claims 5, characterized in that the piston (22) is made in such a way that the said pressure force exerted by the said piston (22) is greater than the reaction force acting on the plane of the junction between the said collector (2) and the lance (4).

16. Device according to claim 9, characterized in that the said clamping means (25) comprise springs which are positioned between the coupling head (2) and the said piston (22), the said springs being pre-stressed during the coupling of the lance (4) to the coupling head (2).

17. Device according to claim 10, characterized in that the said clamping means (25) comprise springs which are positioned between the coupling head (2) and the said piston (22), the said springs being pre-stressed during the coupling of the lance (4) to the coupling head (2).

18. Device according to claim 9, characterized in that one of the said two coupling surfaces (12 or 14) comprises a protruding annular edge (48) extending axially, the said annular edge (48) having an inner diameter which is roughly equal to the outer diameter of the other of the said coupling surfaces (14 or 12).

19. Device for coupling a blowing lance to a collector, comprising:

a piston having a pressure surface and a first coupling surface, said piston being positioned with respect to the blowing lance and collector so as to be shiftable with respect to the blowing lance and collector such that a coupling fluid and/or a blowing fluid, which is supplied to the lance, extends a force on said pressure surface to place said first coupling surface of said piston in an impervious junction relationship with respect to a second coupling surface of the blowing lance.

20. Coupling device according to claim 19 wherein said piston is slideably received within a recess formed in said coupling head, and said piston includes a plurality of channels for passage of said cooling fluid and blowing fluid.

* * * * *